US006042103A

United States Patent [19]

Yraceburu et al.

[11] Patent Number: 6,042,103

[45] Date of Patent: Mar. 28, 2000

[54] PRINTING MEDIA PICK APPARATUS AND METHOD

[75] Inventors: Robert M Yraceburu, Camas; Jeffrey C O'Bryan; Steve O Rasmussen, both of Vancouver, all of Wash.

[73] Assignee: Hewlett-Packard, Ft. Collins, Colo.

[21] Appl. No.: 08/977,855

[22] Filed: Nov. 25, 1997

[51] Int. Cl.[7] ..... B65H 3/06; B65H 1/08; B65H 1/00

[52] U.S. Cl. ..... 271/118; 271/127; 271/162

[58] Field of Search ..... 271/118, 127, 271/162

[56] References Cited

U.S. PATENT DOCUMENTS

| | | | |
|---|---|---|---|
| 4,025,066 | 5/1977 | Sue | 271/9 X |
| 4,346,878 | 8/1982 | Aizawa | 271/118 |
| 5,358,230 | 10/1994 | Ikemori et al. | 271/114 X |
| 5,443,252 | 8/1995 | Morinaga et al. | 271/127 |
| 5,863,036 | 1/1999 | Tanaka et al. | 271/10.11 X |

FOREIGN PATENT DOCUMENTS

| | | |
|---|---|---|
| 0338578 | 10/1989 | European Pat. Off. . |

*Primary Examiner*—Christopher P. Ellis
*Assistant Examiner*—Kenneth W Bower

[57] ABSTRACT

A media feed apparatus for a printer, with a motorized media pick mechanism and a media support plate movable toward and away from the pick element, so that a stack of media on the plate may be brought into contact with the pick mechanism. A lifter assembly is continuously movable between a first position and a second position, and has a cam surface supportably contacting the media support plate. A first cam surface portion contacts the support plate when the lifter assembly is in the first position, and a second cam surface portion contacts the support plate when the lifter assembly is in the second position. The support plate may have a protrusion over which the cam surface slides, and the cam may pivoted to provide a selectable lever arm, depending on the point of contact.

20 Claims, 5 Drawing Sheets

PRINTING MEDIA PICK APPARATUS AND METHOD

FIELD OF THE INVENTION

This invention relates to methods and apparatus for handling printing media, and more articularly to picking a single sheet from the media supply of a printer.

BACKGROUND AND SUMMARY OF THE INVENTION

Computer printers such as ink jet printers normally operate by drawing single sheets of blank media (such as paper or transparent film) from a horizontal stack of sheets. Each sheet is individually drawn or "picked" from the stack, and into the media path of a printer. If no sheets are drawn during an attempted pick, a "no pick" failure has occurred; if two (or more) sheets are picked in an overlapping manner, a "two (or multiple) pick" failure has occurred. In the event of either type of failure, printing may be suspended, media wasted, and a user inconvenienced.

A typical pick mechanism includes a drive or pick roller oriented just above a leading edge of the media stack, for rotation about an axis parallel to the stack edge. The roller has one or more tires spaced along its length. When the leading edge of the stack is lifted, the top sheet contacts the tire surface, and rotation of the roller slides the top sheet off the remaining stack. To help prevent multiple picks, a separator pad opposite one tire rubs on the opposite surface of the picked sheet or sheets. With respect to a media surface, the friction coefficient of the separator is less than that of the pick tire, and greater than that of media, so that a properly picked single sheet proceeds along the media path, while the improper lower sheets of a multiple pick is held by the pad as the upper sheet proceeds alone.

Proper picking action depends largely on the pick force between the upper sheet and the pick tire or tires. If the force is too great, multiple picks are more likely to occur; if the force is too low, "no picks" are more likely. A complicating variable is the changing weight of the media stack as the media tray proceeds from full to empty. Because the force pressing the stack against the pick tire is critical, the mechanism providing this force must provide greater lifting force at the early stages of media depletion than at later stages. At early stages with a full media tray, a smaller displacement is needed to lift the top sheet into contact with the pick tire, as compared at the late stages, when the media tray must be lifted higher, but with less force. This has been addressed in existing printers by the use of conventional springs that provide a linear force or assist proportional to displacement, to neutralize the effects of the media stack weight.

Proper media picking is dependent on many secondary variables, even when the stack weight has been compensated for. As a stack is depleted, the media support plate tilts, and the angle of attack of the top sheet relative to the pick tire changes. Also, as stack height changes, the compressibility of the stack changes, affecting the interaction with the pick tire, and the force required to bend the stack by lifting the leading edge varies in manner believed to be non-linear with respect to stack height. A multitude of other variables affect the optimum pick force (i.e. the compressive force of the top sheet against the pick tire,) but many of these are unknown, and may change widely with different printer designs and configurations in a manner that is difficult to predict. Even when a printer is experimentally characterized by testing different pick forces to determine which force yields the fewest pick failures at each of a selected sample of media fill levels, existing mechanisms lack the controllability or flexibility to provide the desired force as a function of fill level. Such functions may be non linear or otherwise complex.

In addition, the springs used to compensate for media weight are subject to significant manufacturing variations. When a spring is being used throughout a wide range of deflections, particularly at low deflections for a low force, it is vulnerable to variations. For instance, a spring that is deflected by 10% at its lowest used force may provide no force if a dimension or other characteristic is more than minimally outside of tolerances. Springs may be used in a more heavily preloaded condition, but this lacks the capability to compensate proportionally for the weight of a media stack that ranges over a very wide percentage variation. Furthermore, the use of heavy spring tension requires substantial motor force to deflect the springs. This limits the amount of motor torque available for other printer functions. Higher capacity motors may be used, but this increases product cost, size, and weight.

The present invention overcomes the limitations of the prior art by providing a media feed apparatus for a printer, with a motorized media pick mechanism and a media support plate movable toward and away from the pick element, so that a stack of media on the plate may be brought into contact with the pick element. A lifter assembly is continuously movable between a first position and a second position, and has a cam surface supportably contacting the media support plate. A first cam surface portion contacts the support plate when the lifter assembly is in the first position, and a second cam surface portion contacts the support plate when the lifter assembly is in the second position. The support plate may have a protrusion over which the cam surface slides, and the cam may pivoted to provide a selectable lever arm and or contact angle, depending on the point of contact.

DETAILED DESCRIPTION OF A PREFERRED EMBODIMENT

Figure 1:
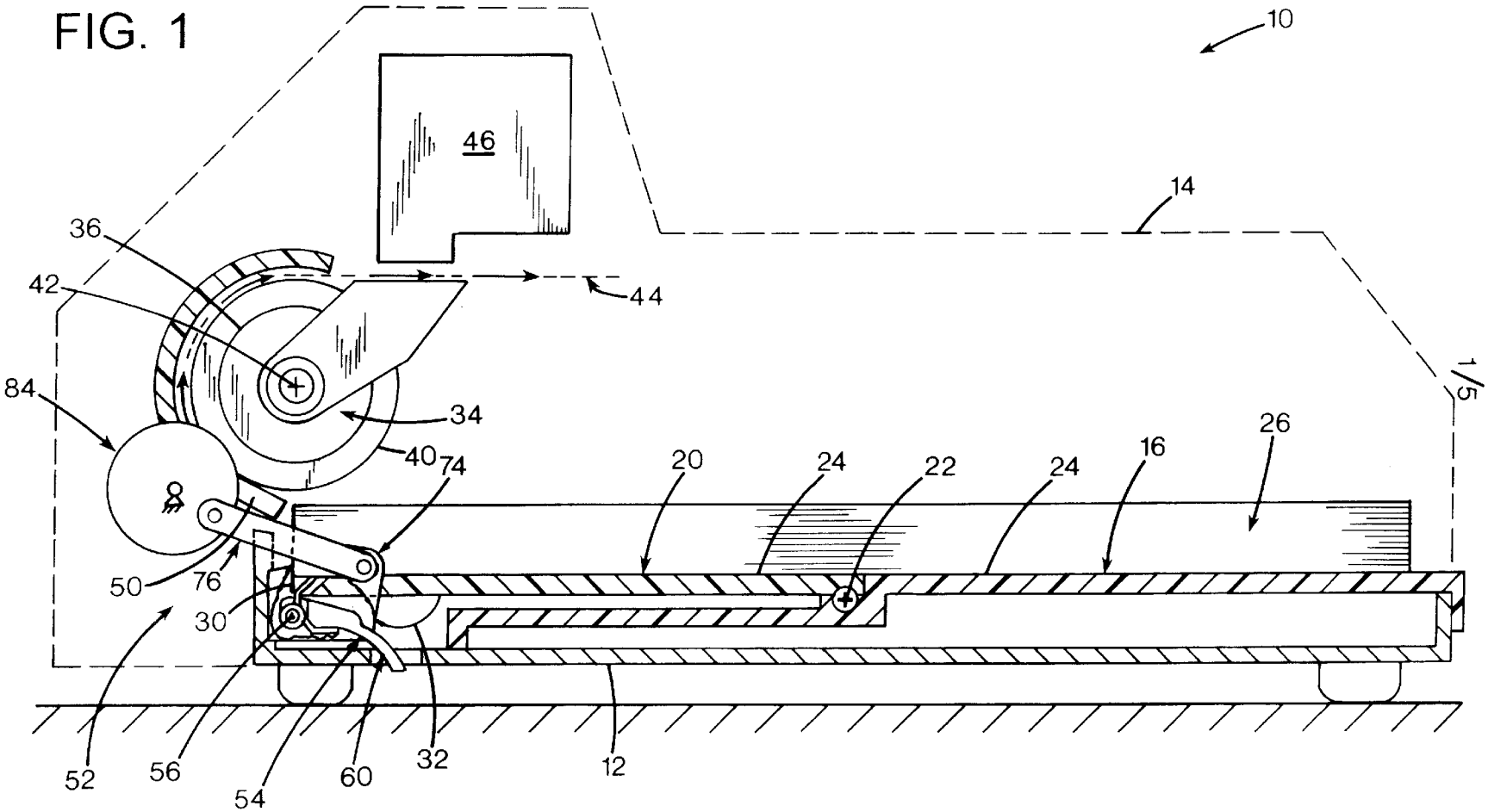
FIG. 1 is a sectional side view of a printer according to a preferred embodiment of the invention.

FIG. 1 shows an ink jet printer 10 having a chassis or frame 12, a housing 14 connected to the frame, and a media support tray having a fixed portion 16 resting on the frame, and a tilting portion 20 connected to the fixed portion.

The tilting portion of the media support tray 20 pivots about a tray pivot axis 22. The tray has a horizontal upper media support surface 24 that provides a flat surface supporting a stack of media 26 such as paper or transparent film. The tray's pivot axis 22 is positioned near a midpoint along the length of the tray, just below the upper surface. The tilting tray portion 20 has a free edge 30 corresponding to the leading edges of the media sheets. A row of semi cylindrical lobes 32 protrude from the lower surface of the tiltable portion, near the free edge. The lobes are spaced apart, and arranged coaxially along a line parallel to the free edge.

A media drive or pick roller assembly 34 is connected to the frame and positioned just above the free edge 30 of the tiltable tray. The assembly includes a roller 36 having several tires 40, and is rotatable about a roller axis 42 oriented parallel to all other axes of rotation or pivoting discussed herein. A motor (not shown) is operably connected to drive the roller to draw sheets from the media stack, and to controllably feed sheets along the media path.

A cylindrically curved media guide is spaced apart from the tires 40 to define a curved media path 44. The media path begins at the lower edge of the tires, in the plane of the top media sheet, and wraps around the tires, upward, and continues horizontally away from the upper tangent to the pick tires. An ink jet pen 46 on a carriage movable along a scan axis parallel to the roller axis is positioned just above this horizontal portion of the media path. Separator pads 50 below the tires and near the free edge of the tilting media tray is movable into and out of proximity with the tires to conventionally reduce the risk of multiple sheets proceeding simultaneously along the media path As shown in greater detail in FIG. 2, a tray lifter assembly 52 is mechanically connected to the pick assembly to be driven synchronously therewith, and engages the lobe 32 of the tiltable tray 20 for lifting the leading edge of the media stack into forceful contact with the pick tires 40. An elongated lifter element 54 includes an elongated lifter shaft 56 journaled for rotation with respect to the frame, and positioned just below and parallel to the free edge of the tiltable tray. A pair of lifter arms 60 extend roughly perpendicularly from the shaft, registered with the tray lobes 32, and extend below and beyond the lobes. Counterclockwise rotation of the shaft causes the arms to elevate into contact with the lobes, thereby to elevate the tiltable tray portion. The arms are fixed to the shaft, preferably rigidly unitary therewith, such as by insert molding of plastic arm to a metal shaft, so that a sufficient torque applied to the shaft or to one arm causes both arms to pivot simultaneously.

An eccentric-driven four bar linkage 62 connects to the lifter arms via a cylindrical coil torsion spring 64 installed about the lifter shaft. The spring has two legs extending away from the lifter shaft. A first leg 66 rests beneath or clockwise from one of the lifter arms 60, and a second leg 70 above or counterclockwise from a stop 72 on a rocker arm 74 that freely pivots on the lifter shaft 56. A lifter drive link 76 is pivotally connected at a first end to the rocker arm at a rocker pivot 80 distal from the lifter shaft and above and to the right, as shown. An opposed end of the link is pivotally connected to an eccentric pivot 82 on a lifter drive gear 84 mounted to the frame. The gear 84, link 76, arm 74, and frame comprise the four bars of the linkage. The length of the gear "link" is less than that of the rocker arm "link" so that multiple rotations of the gear will generate limited reciprocation of the rocker arm about the lifter axis.

Although the rocker arm 74 pivots independently of the lifter arms 60, a rotation stop limits clockwise rotation of the rocker past the lifter arm beyond the position illustrated. In the rest position shown in FIG. 2, the spring is preloaded so that the legs 66 and 70 are biased toward each other, and the rocker arm is biased against the lifter arm. The preload amount is about 200° of rotation from the neutral position.

The lifter arm has a cylindrically curved upper cam surface 86 that is convex upward, and faces somewhat laterally toward the tray axis 22. The cam surface extends to the free end of the lifter arm, from a first surface portion 90 at an intermediate position on the arm at limited radius from the lifter axis, to a second surface portion 92 near the free end, at a greater second radius. The first portion 90 is positioned below a left portion of tray lobe 32; the second portion 92 extends laterally beyond the mid pint of the lobe.

In the preferred embodiment, the lifter axis 56 is positioned 130.3 mm left of and 3 mm below the tray pivot axis, which is about 6 mm below the tray surface 24. The tray lobes have a radius of 10 mm, on an axis positioned 104.3 mm left of the tray axis, and 4.4 mm above. The cam surface of the lifter arms has a radius of 35 mm, defined by an axis 31.5 mm below the lifter shaft axis, and 1 mm to the left. The lifter arm extends to a length of about 32 mm from the lifter shaft axis. When fully loaded, the media stack height is 17 mm. The major components are plastic, with the tray lobes and lifter arms being or plastic materials selected for low friction and good wear resistance. The lifter gear 84 is driven via an arrangement of idler and transmission gears connected to the pick roller, with conventional mechanisms providing for one rotation of the lifter gear and an idle period, for every selected number of roller rotations needed to advance a single sheet through the sheet path.

Figure 2:
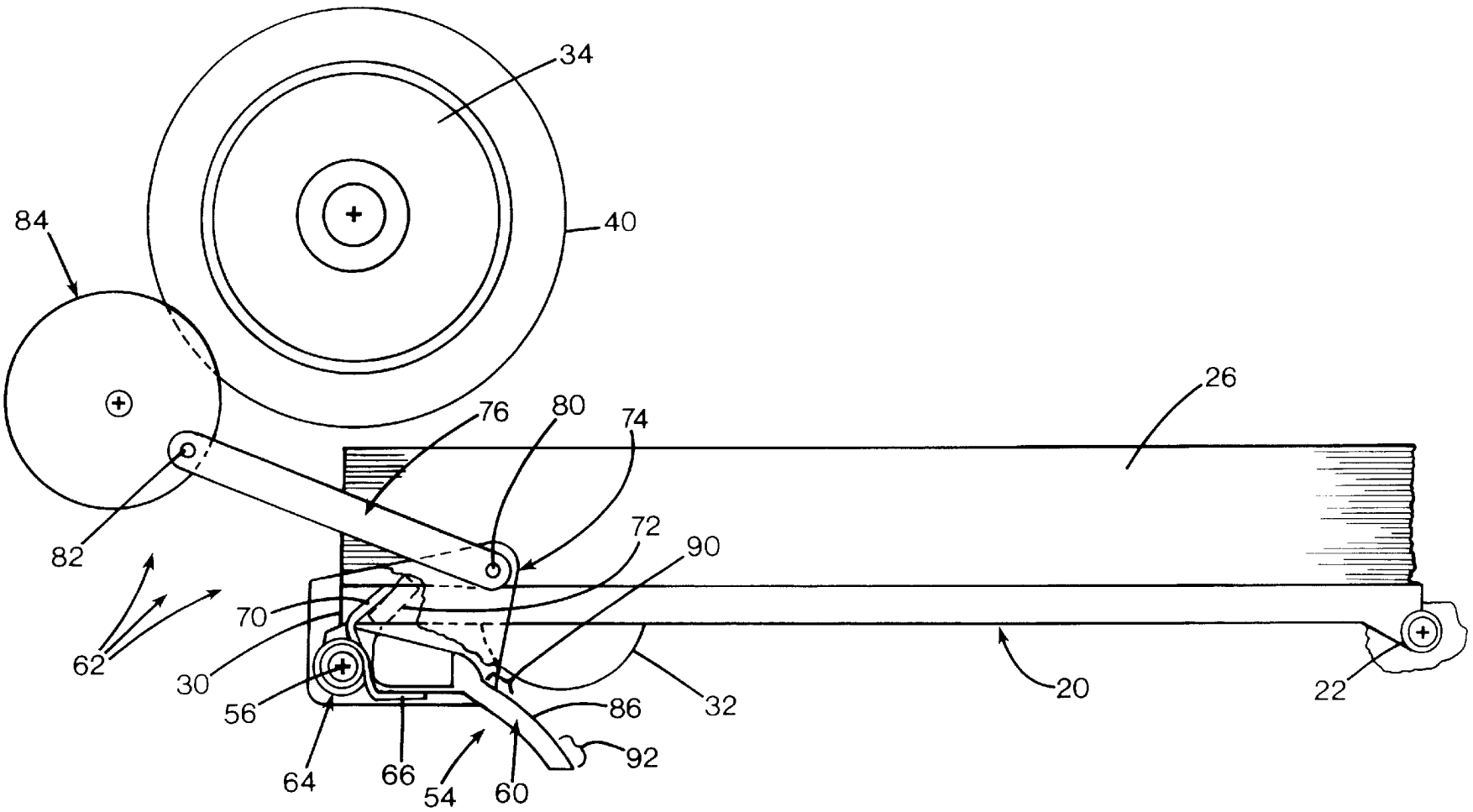
FIGS. 2–5 are simplified sectional side views of the printer of FIG. 1 showing a sequence of operation.

FIG. 2 shows the feed mechanism in an idle state, with a full media tray. The idle state is the same for all possible fill levels as well. In the idle state, the printer may be inactive, or may be advancing and printing a sheet that has already been picked from the stack. The tray 20 is in a lowered position at 0° elevation from horizontal. The top sheet of even a full media stack 26 is spaced apart from the pick tire 40. The lifter arms 60 are spaced apart from the tray lobes, in an orientation of 0°. The rocker arm 74 is in a stopped position of maximum clockwise rotation, biased against the lifter shaft by the spring. The lifter drive gear 84 has the eccentric pivot 82 toward the rocker pivot 80.

Figure 3:
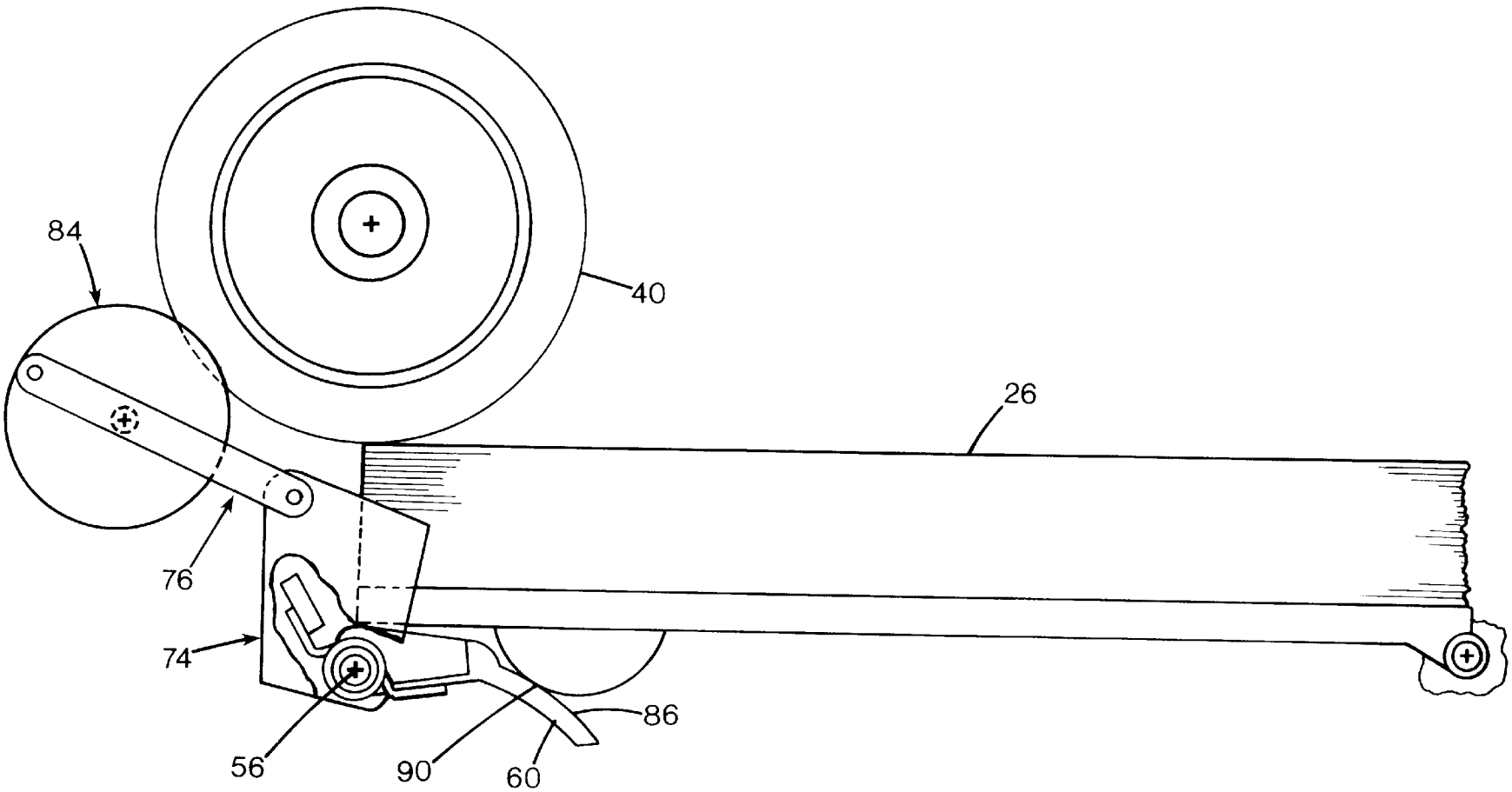

In FIG. 3, the lifter drive gear 84 has been rotated to maximally pivot the rocker arm 74. In the course of the gear rotating from the idle position to the extended position shown, the lifter shaft initially pivots as a unit with the rocker arm. The lifter arms then contact the tray lobes. As gear rotation proceeds, the tray elevates until the top media sheet contacts the pick tire 40. As gear rotation further proceeds, the rocker arm pivots away from the lifter arm, increasing spring torque, and increasing the compressive force of the top sheet against the tire. During the entire process, the pick roller continues its constant rotation. With the tray full of media to a maximum stack height, compressive contact will be provided during a significant period of gear rotation, so that the gear rotation need not stop or idle to provide the more than momentary period of pressure needed to pick a sheet. Thus, the gear rotation may be simply mechanically linked to the pick roller rotation. With the full stack shown, the lifter arm cam surface contacts the tray lobe 32 at a contact point 90 radially spaced apart 22 mm from the lifter shaft axis. The lifter shaft is elevated by 15°, and the tray is elevated by 1.35°. The spring, with a spring constant of 0.49 Nmm/degree of rotation is tensioned by an additional approximately 50° beyond the preload amount; the additional angular displacement being the rocker arm pivot less the lifter shaft pivot. The rocker arm has rotated by 65°.

Figure 4:
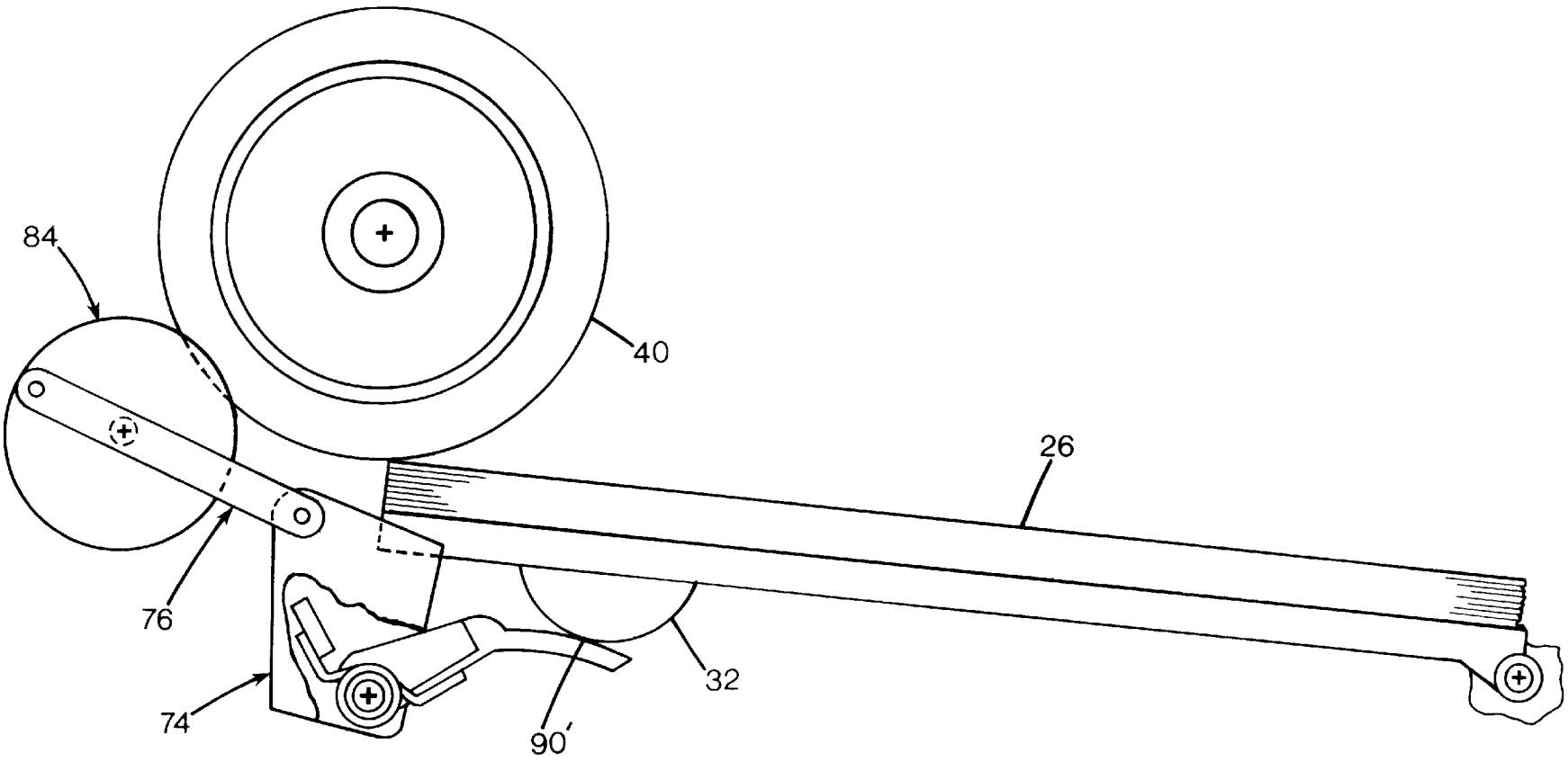

In FIG. 4, the media tray has been half depleted by picking and printing. As with any media stack height or fill level, the lifter drive gear 84 has been rotated to maximally pivot the rocker arm 74 by 65°, as above. In the course of the gear rotating from the idle position to the extended position shown, the lifter arms progress as above, except that the lifter arms rotate to 33.4° rotation before the top sheet contacts the pick tires. With the tray of media at a half stack height, compressive contact will be provided during a lesser period of gear rotation, adequate to provide the more than momentary period of pressure needed to pick a sheet. With the half stack shown, the lifter arm cam surface contacts the tray lobe 32 at a contact point 90' radially spaced apart 25.6 mm from the lifter shaft axis. The lifter shaft is elevated by 33.4°, and the tray is elevated by 5.13°. The spring is tensioned by an additional approximately 31.6°, providing less torque as the weight of the stack is reduced. In addition, the increased effective radius of the lifter arm reduces leverage and thereby the force provided to lift the tray to further compensate for the reduced weight, while providing an increased tray elevation for a given rotation angle of the lifter arm.

Figure 5:
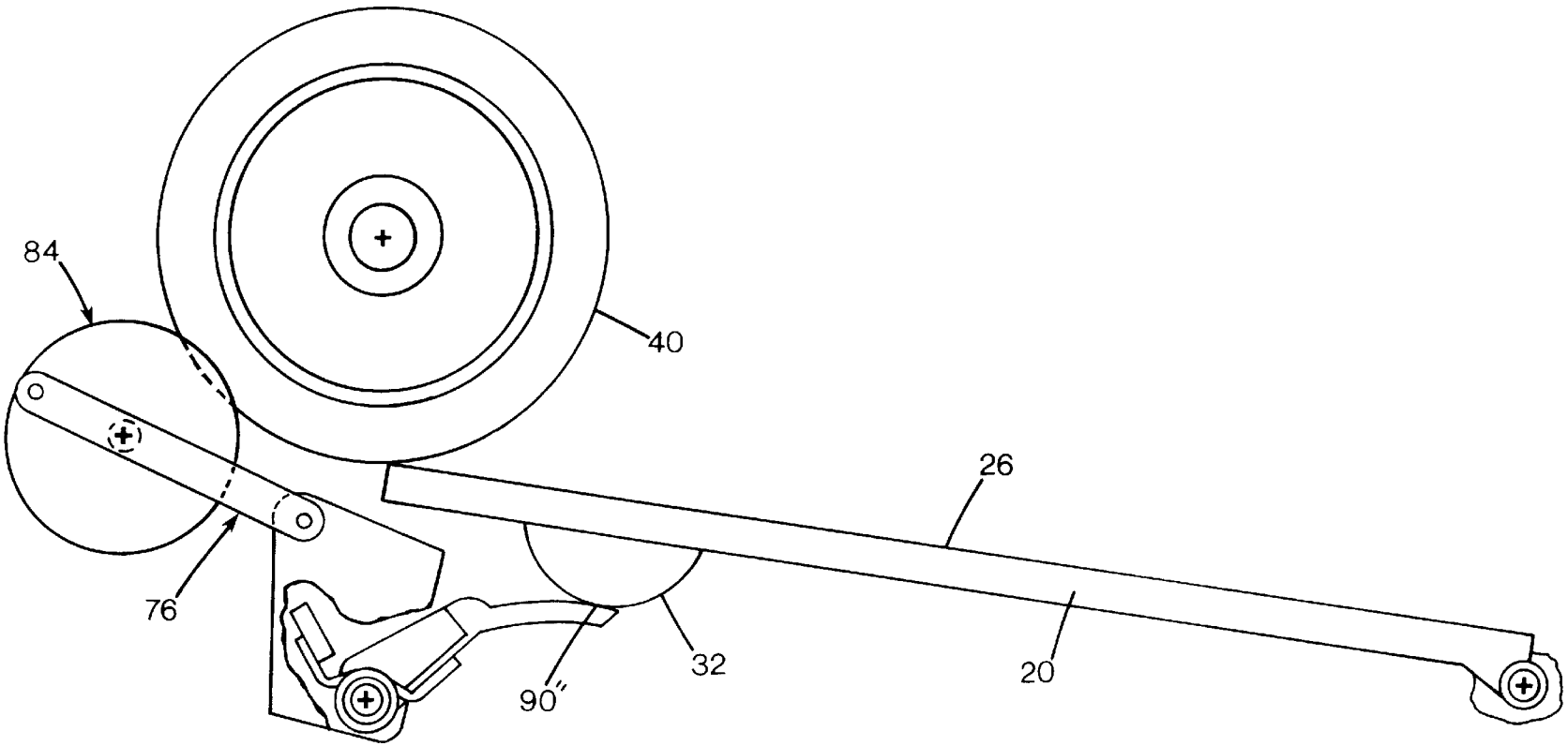

In FIG. 5, the media tray is essentially depleted with one sheet remaining. As above, the lifter drive gear 84 has been rotated to maximally extend the link 76, maximally pivoting the rocker arm 74. In the course of the gear rotating from the idle position to the extended position shown, the lifter arms progress as above, except that the lifter arms rotate to 50° rotation before the top sheet contacts the pick tires. With the tray of media at a minimum stack height, compressive contact will be provided during a minimum but adequate period of gear rotation. With the minimum stack shown, the lifter arm cam surface contacts the tray lobe 32 at a contact point 90" radially spaced apart 30.4 mm from the lifter shaft axis. The lifter shaft is elevated by 50°, and the tray is elevated by 8.9°. The spring is tensioned by an additional approximately 15°, providing still less torque as the weight of the stack is reduced. As above, the increased effective radius of the lifter arm reduces the force provided to lift the tray to further compensate for the reduced weight, and increases tray displacement for a given lifter pivot angle.

By using the principles of cam design, and accounting for the geometry of the pivoting tray, lifter, and spring, the resulting pressure at various stack heights may be controlled. Modifying the lobe and lifter surface shapes and positions is particularly effective at changing the force function. To minimize the spring force, and thus the torque required to wind it up for tray lifting, the maximum stack weight is critical, as the spring must overcome the weight in addition to providing tire contact force. Thus, a cam design with a minimum lifter radius to the point of contact (when the tray is full) maximizes the force from a limited-torque spring. After the stack height reduces, the spring is required to lift less weight, and a longer lever arm may be tolerated. However, there is a limited 35° of lifter arm pivoting between the elevated tray positions in the full and empty conditions. This constraint is determined by other printer timing functions, and means that the lifter arm must provide adequate tray elevation (more than the full stack height) from the limited lifter rotation. The elongated curved end of the lifter arm provides the required elevation change for the limited lifter rotation as the media approaches depletion. Thus, the expected trade off between force and tray elevation range (for a given spring torque) is at least partially avoided by using the curved cam surfaces to provide varying leverage as needed for the full range of possible media stack heights.

While the above is discussed in terms of preferred and alternative embodiments, the invention is not intended to be so limited.

We claim:

1. A media feed apparatus for a printer, comprising:

a frame;

a motorized media pick element connected to the frame;

a media support plate connected to the frame and movable toward and away from the pick element, such that a stack of media on the plate may be brought into contact with the pick element;

a lifter assembly connected to the frame and continuously movable between a first position and a second position;

the lifter assembly including a cam surface supportably contacting the media support plate and having a first cam surface portion contacting the support plate when the lifter assembly is in the first position to position the support plate in a first plate position away from the pick element, and having a second cam surface portion contacting the support plate when the lifter assembly is in the second position to position the support plate in a second plate position closer to the pick element; and wherein the lifter assembly is rotatable about a lifter axis, and wherein the first cam surface portion contacts the support plate at a first location laterally spaced apart from the lifter axis by a first amount, and the second cam surface portion contacts the support plate at a second location laterally spaced apart from the lifter axis by a second amount greater than the first amount.

2. The apparatus of claim 1 wherein the lifter assembly has a radial length extending from an axis of rotation to a free end, and wherein the cam surface is convexly curved over a significant fraction of the radial length.

3. The apparatus of claim 1 wherein the lifter assembly is spring biased toward the second position.

4. The apparatus of claim 1 wherein the media support plate is movable between a media full position when supported by the lifter assembly in the first position, and a media empty position when supported by the lifter assembly in the second position.

5. The apparatus of claim 1 wherein the media support plate includes a protrusion contacting the cam surface.

6. The apparatus of claim 5 wherein the protrusion comprises a convex lobe.

7. A printer comprising:

a frame;

a motorized media pick element connected to the frame;

a media support plate defining a major plane and connected to the frame and movable toward and away from the pick element, such that a stack of media on the plate may be brought into contact with the pick element;

the media support plate including a protrusion extending from the major plane;

a lifter assembly pivotally connected to the frame for pivoting about a lifter axis between a first position and a second position; and the lifter assembly including a lifter arm extending away from the lifter axis and having a cam surface supportably contacting the protrusion of the media support plate, and operable to bias the media support plate toward the pick element by pressing on the protrusion.

8. The apparatus of claim 7 wherein the lifter arm has a first cam surface portion contacting the support plate when the lifter assembly is in the first position, and having a second cam surface portion contacting the support plate when the lifter assembly is in the second position.

9. The apparatus of claim 7 wherein the first cam surface portion is spaced apart from the lifter axis at a first radius, and the second cam surface portion is spaced apart from the lifter axis at a second radius.

10. The apparatus of claim 7 wherein the pressure plate is movable between a media full position when supported by the lifter assembly in the first position, and a media empty position when supported by the lifter assembly in the second position.

11. The apparatus of claim 7 wherein the protrusion of the media support plate comprises a convex lobe contacting the cam surface.

12. The apparatus of claim 7 wherein the protrusion includes a surface occupying a second plane angularly offset from the major plane of the media support plate.

13. The apparatus of claim 7 wherein the support plate has a first media support surface on which a stack of media rests, and an opposed rear surface from which the protrusion protrudes.

14. The apparatus of claim 7 wherein the first cam surface portion contacts the support plate at a first location laterally spaced apart from the lifter axis by a first amount and supports the support plate in a first plate position spaced apart from the pick element, and the second cam surface portion contacts the support plate at a second location laterally spaced apart from the lifter axis by a second amount greater than the first amount and supports the support plate in a second plate position spaced apart from the pick element by a lesser amount.

15. A method of feeding a stack of media sheets from a media support plate to a printer feed mechanism having a frictional feed surface proximate to an edge of the media stack, the method comprising the steps:

moving the support plate to bring the media stack into contact with the feed surface, including moving a plate lifter arm into contact with the support plate and generating a first force of the lifter arm against the support plate by applying a first torque to the arm about an arm pivot axis and contacting the plate with a first portion of the arm laterally spaced apart from the pivot axis by a first amount;

feeding at least a first sheet from the support plate to leave a remaining stack on the support plate; and after feeding the first sheet, moving the support plate to bring the remaining stack into contact with the feed surface, including moving the plate lifter arm into contact with the support plate and generating a second force of the lifter arm against the support plate by applying a second torque to the arm about an arm pivot axis and contacting the plate with a second portion of the arm laterally spaced apart from the pivot axis by a second amount greater than the first amount.

16. The method of claim 15 wherein the support plate includes a protrusion, and wherein moving the lifter arm includes sliding the arm against the protrusion, including contacting the protrusion with different selected portions of the arm along a sliding path.

17. The method of claim 15 wherein moving the arm includes spring biasing the arm against the support plate.

18. The method of claim 15 wherein the first torque and second torque are applied by a preloaded spring member such that the lesser of the first and second torque is significantly greater than a difference between the first and second torques, and wherein the difference in force generated is due to a significant difference in the first and second arm spacing amounts.

19. The method of claim 15 wherein the first force is greater than the second force.

20. The method of claim 19 including feeding at least an additional sheet after generating the second force, and generating a third force greater than the second force after feeding the additional sheet.

* * * * *